United States Patent [19]

Müller et al.

[11] Patent Number: 5,042,368

[45] Date of Patent: Aug. 27, 1991

[54] VENTILATION GRILL

[75] Inventors: Gottfried Müller; Paul Hipp, both of Kolbingen, Fed. Rep. of Germany

[73] Assignee: Schako Metallwarenfabrik Ferdinand Schad KG, Kolbingen, Fed. Rep. of Germany

[21] Appl. No.: 490,822

[22] Filed: Mar. 7, 1990

[30] Foreign Application Priority Data

Mar. 9, 1989 [DE] Fed. Rep. of Germany ..... 3907559

[51] Int. Cl.[5] ..... F24F 13/14

[52] U.S. Cl. ..... 98/114; 98/101

[58] Field of Search ..... 98/41.3, 101, 103, 107, 98/108, 110, 114; 72/379

[56] References Cited

U.S. PATENT DOCUMENTS 205,786 7/1878 Collins ..... 98/110
766,957 8/1904 Lloyd ..... 98/101
1,559,376 10/1925 Riker ..... 98/101 X
3,500,739 3/1970 Dry ..... 98/110
4,426,918 1/1984 Lambert ..... 98/41.3 X

FOREIGN PATENT DOCUMENTS 2608053 9/1977 Fed. Rep. of Germany ..... 98/41.3

*Primary Examiner*—Harold Joyce
*Attorney, Agent, or Firm*—Bachman & LaPointe

[57] ABSTRACT

A ventilation grill comprising a housing having a rear wall provided with apertures and side walls projecting from the rear wall defining a compartment having an opening wherein fins are pivotably mounted on the side walls for controlling the flow of air through the opening. A damper is located in the compartment defined by the side walls and rear walls between the fins and the rear wall for controlling the passage of air therebetween.

9 Claims, 2 Drawing Sheets

VENTILATION GRILL

BACKGROUND OF THE INVENTION

The present invention relates to a ventilation grill having a housing, which, firstly, forms an opening in which fins are installed, and secondly, possesses a rear wall with slots which is provided with a movable slot damper.

Ventilation grills are known in multifarious forms and designs. They serve to supply and extract air, for example, in ducted applications, and have vertical or horizontal drop fins at the front. They can be made from metal or plastic and serve multifarious applications.

In existing ventilation grills the fins are located in their own housing frame, from which corresponding lateral strips are bent away in the form of a collar for the purpose of locating this housing frame. A second frame, which supports the arrangement with the slot damper is then mounted on the housing frame. As a rule, most of the parts of this known ventilation grill are joined by welding, and this results in substantial problems in the working of finished or coated sheets.

Furthermore, in known ventilation grills, there are junctions from one part of the frame to the other which, for example, deflect air jets and lead to eddies inside the ventilation grill. Moreover, substantial deposits of dust, which are not desirable on account of hygiene, form at these shoulders.

Accordingly, the inventors set themselves the task of developing a ventilation grill of the type mentioned above with which these disadvantages are avoided, and with which, in particular, manufacturing is facilitated and for this reason more cost-effective. Furthermore, the use of material is to be kept as low as possible, and cleaning of the ventilation grill is to be facilitated.

SUMMARY OF THE INVENTION

The foregoing objects are achieved by forming the housing of the grill in one piece.

By forming the housing in one piece, edges and shoulders inside the housing are avoided, so that the guidance of air is improved. In the ventilation grill according to the invention, it is not possible for the air jet to hit either an edge or a shoulder, and thereby to be deflected. Consequently, the entire interior of the ventilation grill remains free from eddies, and can be employed for the supply of air.

Secondly, the entire grill is substantially easier to maintain and keep clean, because there are no disturbing, circumferential shoulders by way of which the grill is assembled. Deposits of dust, bacteria or similar filth can no longer settle in the ventilation grill.

It is preferable for the side walls, which form an actual housing box, to be folded away from a rear wall of one single strip of material. The slot damper and the fins are then seated in this housing box.

Furthermore, lateral strips are bent away from the side walls, so that when seen from the front the entire ventilation grill possesses an aesthetically pleasing, circumferential, uniform frame.

Preferably, the lateral strips overlap in the corner regions, and are joined here to one another and, as the case may be, also to a corresponding pipe or sheet metal duct of the air-conditioning plant. The joining is done, for example, with a hollow rivet, so that welding is entirely inapplicable for this ventilation grill.

This also makes it possible to manufacture the ventilation grill from sheet steel, aluminum, coated sheet, galvanized sheet, chromium-nickel steel, or also from plastic. Apart from this, welding operations always pollute the environment.

The fins are simply installed with their axis in corresponding bore holes of the housing, it being possible for each individual fin per se to be rotated about its axis and thus adjusted. This, too, is a very simple and easy processing step.

The slot damper possesses slots, which are preferably formed by stampings. In this process, the stamped material remains joined to the slot damper via an edge, and is merely bent out of the slot. By this means, the guidance of air inside the ventilation grill is improved, since owing to the outwardly bent wings, the individual air currents of the neighboring slots are shielded from one another.

Above and below, the slot damper itself possesses one guide strip each, over which, in the operating position, a clamping strip or the like engages, and which is thus located in the housing. In this manner, the clamping strip is designed in such a way that the slot damper can be slid in a specific region, and the opening width of the slots is hereby varied.

The ventilation grill according to the invention consists of only a few individual parts, and for this reason the use of material is as low as possible.

However, the production process according to the invention also exhibits a low number of process steps which lead to substantial cost savings. According to the invention, the slots for the rear wall are stamped from a strip of material, the side walls are thereafter folded away, resulting in a housing box, and the lateral strips are thereafter bent away outwards and are then joined to one another in the overlapping regions. This results in the basic housing.

Moreover, the slots of the slot damper are stamped from one strip of material, forming wings, and guide strips are folded away from two sides. This slot damper is then installed in the housing, and located via clamping strips. Thereafter, it is merely necessary for the fins to be installed with their axes in the corresponding boreholes of the housing, or in the openings.

BRIEF DESCRIPTION OF THE DRAWINGS

Further advantages, features and details of the invention will become clear from the following description of preferred illustrative embodiments, and also with reference to the drawings, wherein.

DETAILED DESCRIPTION

Figure 2:
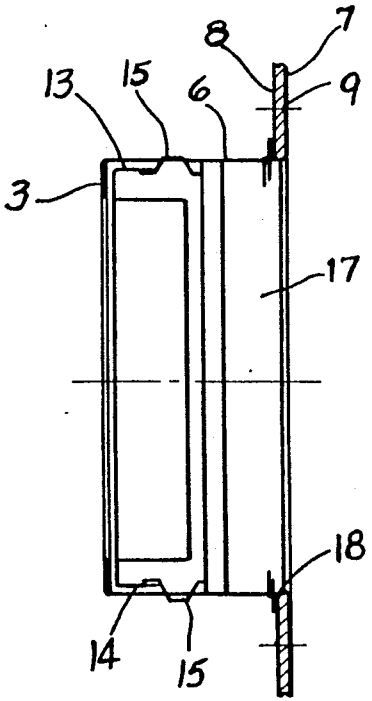
FIG. 2 is a cross-section through the ventilation grill according to FIG. 1 taken along line II—II.
Figure 1:
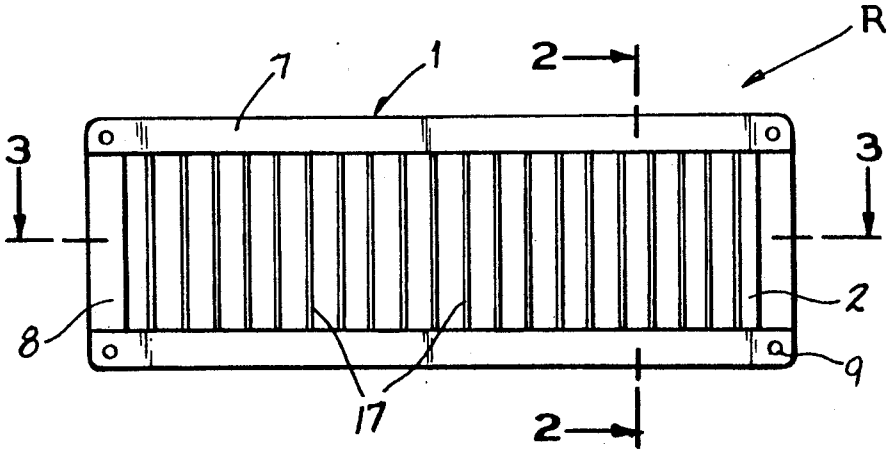
FIG. 1 is a front view of a ventilation grill according to the invention.
Figure 3:
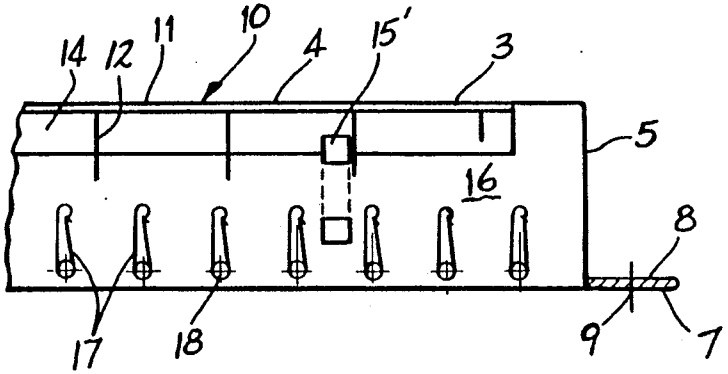
FIG. 3 is a partially represented longitudinal section through the ventilation grill according to FIG. 1 taken along line III—III.

With reference to FIG. 1, a ventilation grill R according to the invention consists of a housing 1 which defines an opening 2 at the front thereof. Housing 1 is formed from a single strip of material as will be made clear hereinbelow. Housing 1 possesses a rear wall 3 in which slots 4 are formed by metal stamping.

Side walls 5 and top and bottom walls 6, which form an actual housing box, are folded away from the rear wall 3.

If desired, lateral strips 7 and/or 8 are bent away from each wall 5 and 6 in the form of a collar, and these strips overlap at the corner points and are joined to one another by means of rivets 9. At the rivet corner points, this hollow rivet 9 likewise serves to fasten the ventilation grill R, for example to a sheet-metal duct of an air conditioning plant or the like.

Through the opening 2, a slot damper 10 is inserted proximate to the back wall 3, and slots 11, which essentially correspond to the slots 4 of the rear wall 3, are likewise formed in this damper by stamping. The stamping of the slots 11 is done along three circumferential sides of the slot, so that stamped wings 12 which are bent away remains. One of the effects of these wings is that the formation of eddies inside the housing 1 is avoided.

Figure 5:
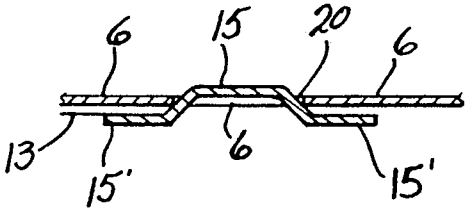
FIG. 5 is an enlarged partial view of the top wall cross-section of FIG. 2.
Figure 6:
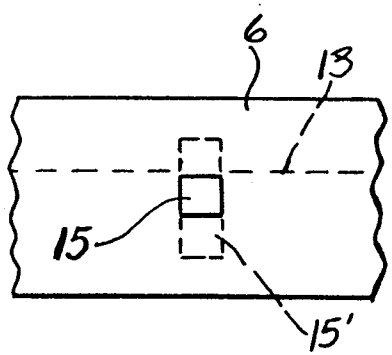
FIG. 6 is a view of FIG. 5 taken from the top.
Figure 4:
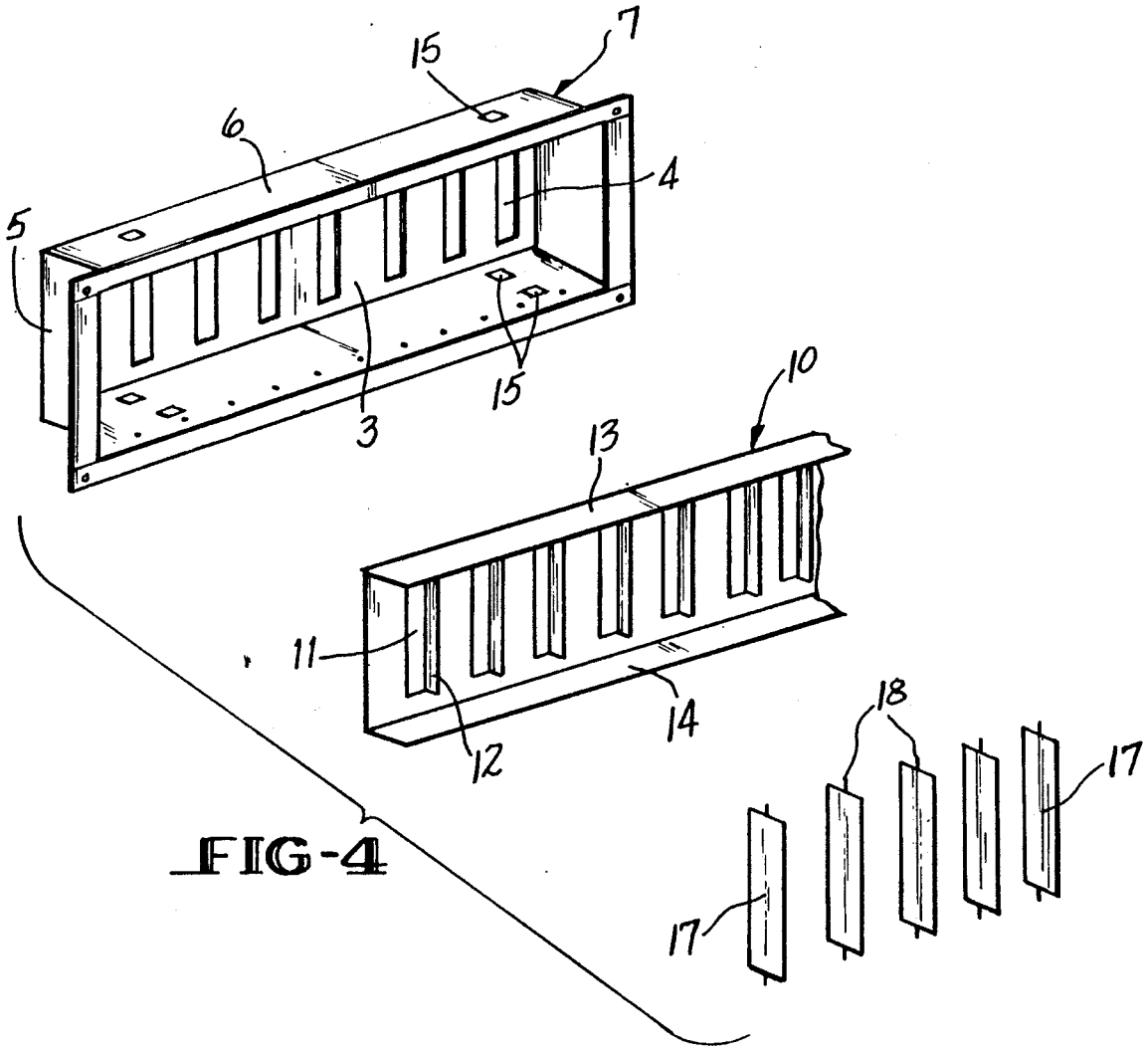
FIG. 4 is a partial exploded view of the ventilation grill of FIG. 1.

Guide strips 13 and 14 are bent away from the top and bottom of slot damper 10. Clamping strips 15 include a pair of offset ears 15', which pass through slot 20 formed in walls 6 of housing 1. As can best be seen in FIG. 5, ears 15' define with walls 6 gaps in which guide strips 13 and/or 14 of slot damper 10 are located for sliding movement therein. The damper 10 is located by simply inserting clamping strips 15 into slots 20 and pressing down to form ears 15'. The clamping strips 15 are arranged in such a way that the slot damper 10, the width of which is smaller than the width of the rear wall, is left free to slide along the rear wall 3 so that the slots 4 can be entirely or partially opened, or closed by moving slot 11 into and out of alignment therewith.

Vertical fins 17 are installed in the opening 2 of the housing 1, and can be rotated about an axis 18 in known manner. Instead of vertical fins, it is also possible, of course, to provide horizontal fins. Each fin 17 per se can preferably be moved about its axis 18.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A ventilation grill comprising a housing having a rear wall provided with at least one aperture and side wall means projecting from said rear wall and defining therewith a compartment having an opening, at least one fin pivotably mounted on said side wall means for controlling the flow of air through said opening, and damper means located in said compartment between said rear wall and said at least one fin for controlling the passage of air between said at least one aperture and said at least one pivotable fin, wherein said damper means has a rear wall provided with at least one aperture for controlling the passage of air and at least one wing is fixed to the rear wall of said damper means in the area of said at least one aperture and projects from said rear wall toward said at least one fin.

2. A ventilation grill according to claim 1 including positioning means for moving said damper means along said rear wall for bringing said at least one aperture on said damper means into and out of alignment with said at least one aperture on said rear wall.

3. A ventilation grill according to claim 1 wherein said housing is formed from a single sheet of material.

4. A ventilation grill according to claim 1 wherein said rear wall of said damper means is provided with a pair of flanges extending toward said fins and projecting from the top and bottom of said rear wall.

5. A ventilation grill according to claim 1 wherein at least one of said pair of opposed side walls is provided with a pair of slits which receive a clamp element which define with the side wall a groove for receiving the flanges extending from the rear wall of the damper means.

6. A ventilation grill comprising a substantially rectangular housing having a rear wall provided with a plurality of apertures and a first and a second pair of opposed side walls projecting from said rear wall and defining therewith a compartment having an opening, a plurality of fins pivotably mounted between one pair of said first and second pair of opposed side walls for controlling the flow of air through said opening, and a substantially rectangular damper means located in said compartment between said rear wall and said plurality of fins, said damper having a plurality of apertures for controlling the passage of air between said plurality of apertures in said rear wall and said plurality of fins, wherein said damper means comprises a rear wall provided with said plurality of apertures and wherein a wing member is fixed to the rear wall of said damper means and projects from said rear wall in the area of each of said plurality of apertures towards said plurality of fins.

7. A ventilation grill according to claim 6 wherein positioning means are provided on said damper means for moving said damper means along said rear wall within said compartment for bringing said plurality of apertures on said damper means into and out of alignment with said plurality of apertures provided on said rear wall for controlling the passage of air.

8. A ventilation grill according to claim 6 wherein said housing is formed from a single sheet of material.

9. A ventilation grill comprising a substantially rectangular housing having a rear wall provided with a plurality of apertures and a first and a second pair of opposed side walls projecting from said rear wall and defining therewith a compartment having an opening, a plurality of fins pivotably mounted between one pair of said first and second pair of opposed side walls for controlling the flow of air through said opening, and a substantially rectangular damper means located in said compartment between said rear wall and said plurality of fins, said damper having a rear wall provided with a plurality of apertures for controlling the passage of air between said plurality of apertures in said rear wall and said plurality of fins, wherein said rear wall of said damper means is provided with a pair of flanges extending towards said fins and projecting from the top and bottom of said rear wall and wherein at least one of said pair of opposed side walls are provided with a pair of slits which receives a clamp element which defines with the side wall a groove for receiving the pair of flanges extending from the rear wall of the damper means.

* * * * *